US007168099B2

(12) United States Patent
Aoki

(10) Patent No.: US 7,168,099 B2
(45) Date of Patent: Jan. 30, 2007

(54) BASKET WEB AND BALL CATCHING TOOL USING THE SAME

(75) Inventor: Akio Aoki, Osaka (JP)

(73) Assignee: Trion Corporation, Osaka (JP)

( * ) Notice: Subject to any disclaimer, the term of this patent is extended or adjusted under 35 U.S.C. 154(b) by 156 days.

(21) Appl. No.: 10/979,257

(22) Filed: Nov. 2, 2004

(65) Prior Publication Data

US 2006/0090236 A1 May 4, 2006

(51) Int. Cl.
*A41D 19/00* (2006.01)

(52) U.S. Cl. ..... 2/161.1; 2/19; 2/159

(58) Field of Classification Search ..... 2/161.1, 2/19, 159

See application file for complete search history.

(56) References Cited

U.S. PATENT DOCUMENTS

| | | | | | |
|---|---|---|---|---|---|
| 2,414,004 | A | * | 1/1947 | Turner | 2/19 |
| D153,186 | S | * | 3/1949 | Sonnett | D29/115 |
| 3,321,771 | A | * | 5/1967 | Latina | 2/19 |
| D211,848 | S | * | 8/1968 | Khazzam | D29/123 |
| D213,286 | S | * | 2/1969 | Khazzan | 135/30 |
| D213,288 | S | * | 2/1969 | Khazzan | D29/123 |
| 3,602,915 | A | * | 9/1971 | Collins | 2/19 |
| 4,346,481 | A | * | 8/1982 | Latina | 2/19 |
| D273,820 | S | * | 5/1984 | Neidell | D29/123 |
| 4,853,975 | A | * | 8/1989 | Clevenhagen | 2/19 |
| 5,511,244 | A | * | 4/1996 | Shikatani | 2/16 |
| 5,781,929 | A | * | 7/1998 | Shikatani | 2/16 |
| 5,799,327 | A | * | 9/1998 | Clevenhagen | 2/19 |
| 6,353,931 | B1 | * | 3/2002 | Gilligan et al. | 2/19 |
| 6,487,724 | B1 | * | 12/2002 | Aoki | 2/19 |
| D496,497 | S | * | 9/2004 | Chan | D29/115 |
| 6,952,837 | B1 | * | 10/2005 | Aoki | 2/19 |
| 2001/0014979 | A1 | * | 8/2001 | Park | 2/19 |
| 2005/0268366 | A1 | * | 12/2005 | Anderson | 2/19 |

* cited by examiner

*Primary Examiner*—Gary L. Welch
*Assistant Examiner*—Richale Haney
(74) *Attorney, Agent, or Firm*—Knobbe Martens Olson & Bear LLP

(57) ABSTRACT

A basket web comprising a front web in which a plurality of slits are laterally formed in a substantially central part excluding a peripheral part thereof and stripes are formed between these slits; a back web in which a plurality of slits are formed from an upper side to a lower part in a substantially central part thereof and stripes are formed between these slits, and by passing these stripes through the slits of the front web to be woven, the back web is superposed on the front back and both are fixed; and a reinforcing member in which a plurality of slits are formed and by passing the stripes of the front web through these slits, the reinforcing member is superposed on the front web and the back web to be woven.

10 Claims, 4 Drawing Sheets

BASKET WEB AND BALL CATCHING TOOL USING THE SAME

BACKGROUND OF THE INVENTION

1. Field of the Invention

This invention relates to a basket web and a ball catching tool using this, and particularly to a basket web comprising a reinforcing member and a ball catching tool using this.

2. Description of the Related Art

For a ball catching tool such as a globe and a mitt for use in sports such as baseball and softball, various efforts have been made so as to enable a secure ball catching motion. Provision of a basket web between a thumb and an index finger is one of the efforts.

Since this basket web often receives a flying ball in direct contact, and is mounted between fingers, thereby having no support by hand, it is easily deformed when receiving the ball. In particular, in the case of an unskilled person, since a ball is often caught by receiving at the basket web part instead of receiving at the finger parts, it is more easily deformed. If such deformation is continued, the deformation of the basket web becomes permanent and thus it becomes hard to recover. Therefore, the basket web requires a sufficient strength.

However, when in order to reinforce the basket web, a rigid material or a thick material is used, an alert ball catching motion becomes hard and a weight is increased, which causes trouble that it is hard to use.

SUMMARY OF THE INVENTION

Consequently, an object of the present invention is to provide a basket web in which a rigid material is not used, an increase in weight is minimized, and a reinforcement effect is enhanced, and a ball catching tool using this.

The basket web relating to the present invention comprises a front web in which a plurality of slits are laterally formed in a substantially central part excluding a peripheral part thereof and strips are formed between these slits;

a back web in which a plurality of slits are formed from an upper side to a lower part in a substantially central part thereof and strips are formed between these slits, and by passing these strips through the slits of the front web to be woven, the back web is superposed on the front web and both are fixed; and a reinforcing member in which a plurality of slits are formed and by passing the strips of the back web through these slits, the reinforcing member is superposed on the front web and the back web to be woven.

According to this constitution, since the reinforcing member is firmly fixed integrally with the front web and the back web, an especially rigid material does not need to be used for the reinforcing member, and the thickness does not need to be increased, either. Nevertheless, in a ball catching motion, deformation of the basket web can be securely prevented, and in addition, it is not hard to handle.

The basket web in which a rigid material is not used, an increase in weight is minimized, and a reinforcing effect is enhanced can be provided.

It is preferable that the front web and the back web are woven in a plain weave type shape, the reinforcing member has a band shape, and the strips of the front web are inserted into a pair of slits of the reinforcing member to be woven.

According to this constitution, as the basket web, a stronger structure can be attained, thereby hardly deforming. In addition, since the binding between the reinforcing member and the front web are made by inserting into a pair of slits of the reinforcing member so as to be woven, manufacturing of the basket web does not become complicated, so that the productivity is increased.

It is preferable that the reinforcing member is superposed slantingly with respect to the superposition of the front web and the back web to be woven.

According to this constitution, since a reinforcing effect can be enhanced without enlarging a shape of the reinforcing member, an increase in weight by weaving of the reinforcing member can be minimized.

Furthermore, a ball catching tool relating to the present invention comprises respective finger inserting parts in which a basket web is attached between the index finger inserting part and the thumb inserting part;

wherein the basket web comprises:

a front web in which a plurality of slits are laterally formed in a substantially central part excluding a peripheral part thereof and strips are formed between these slits;

a back web in which a plurality of slits are formed from an upper side to a lower part in a substantially central part thereof and strips are formed between these slits, and by passing these strips through the slits of the front web to be woven, the back web is superposed on the front web and both are fixed; and a reinforcing member in which a plurality of slits are formed and by passing the strips of the back web through these slits, the reinforcing member is superposed on the front web and the back web to be woven.

According to this constitution, the ball catching tool using the basket web in which a rigid material is not used, an increase in weight is minimized, and a reinforcing effect is enhanced can be provided.

Furthermore, it is preferable that in the basket web, the front web and the back web are woven in a plain weave type shape, the reinforcing member has a band shape, and the strips of the front web are inserted into a pair of slits of the reinforcing member to be woven.

Still further, it is preferable that in the basket web, the reinforcing member is superposed slantingly with respect to the superposition of the front web and the back web to be woven.

DETAILED DESCRIPTION OF THE PREFERRED EMBODIMENTS

Figure 1:
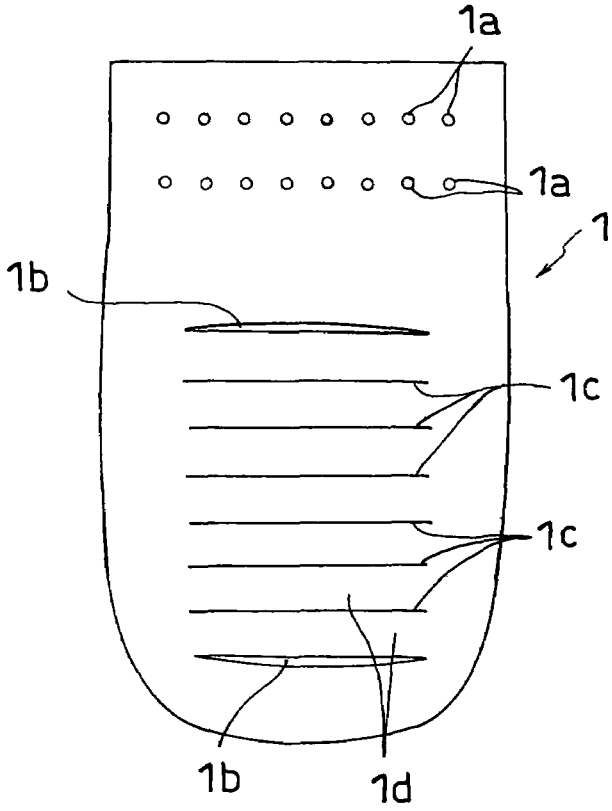
FIG. 1 shows a front view of a front web composing a basket web.

Preferred embodiments of a basket web and a ball catching tool using this relating to the present invention are described in detail, referring to the drawings. FIGS. 1 to 6 show a manufacturing process of the basket web and the basket web.

FIG. 1 shows a plate-like front web 1 made of bull leather, which is a component of the basket web. This front web 1 has a roughly rectangular shape whose upper side is linear and whose lower part is curved, and in an upper part thereof, a plurality of lacing holes 1*a* extending over two rows are formed. Below the lacing holes 1*a*, a plurality of slits 1*c* interposed by upper and lower slightly wide slits 1*b* are laterally formed in a central part excluding a peripheral part. In addition, between the respective slits 1*c*, strips 1*d* are formed in seven rows (No. 1 to 7 from the lower part).

Figure 2:
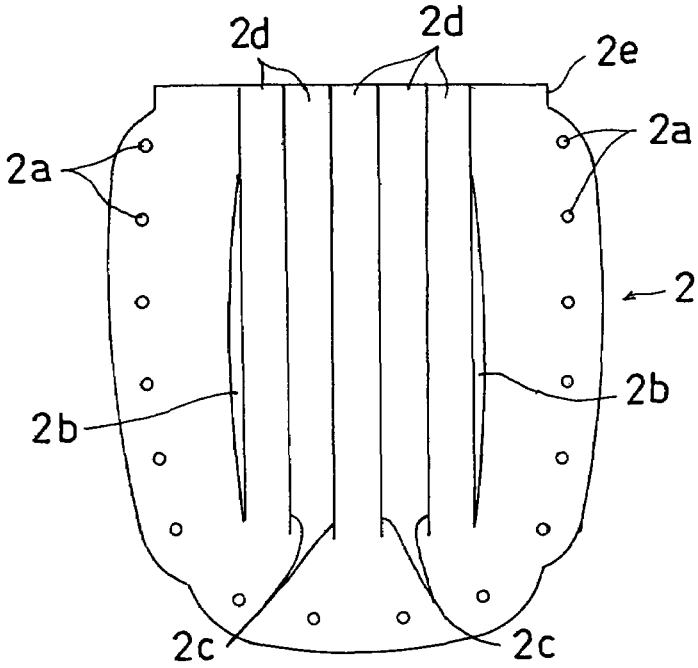
FIG. 2 shows a front view of a back web composing the basket web.

FIG. 2 shows a slightly laterally expanded plate-like back web 2 made of bull leather, which is superposed on the front web 1 in FIG. 1 to compose the basket web. This back web 2 is formed such that an upper side thereof is linear and a lower part thereof is curved. In addition, a plurality of lacing holes 2*a* are formed in a periphery thereof excluding the upper side, and from the upper side to the lower part, right and left slightly wide slits 2*b* and a plurality of narrow slits 2*c* are formed. Furthermore, between the respective slits 2*c*, strips 2*d* are formed in five columns (Nos. 1 to 5 from the left).

Figure 3:
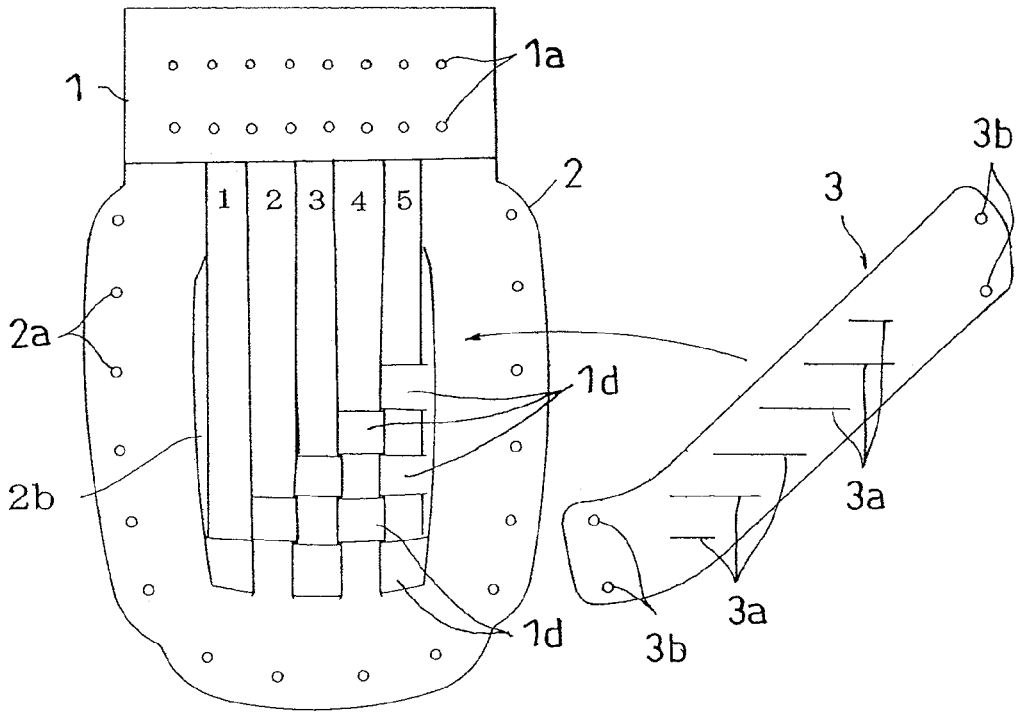
FIGS. 3 to 5 are views for explaining an assembly process of the front web and the back web of FIGS. 1 and 2.

Next, the back web 2 is superposed on, and woven into the front web 1 as shown in FIG. 3, and during weaving, a reinforcing member 3 is further woven. That is, Nos. 1 to 5 of the strips 2*d* of the back web 2 are sequentially laced in order from the lower slit 1*b* of the front web 1 toward the upper slit 1*c*. That is, the strips 2*d* of Nos. 1 to 5 are sequentially passed through the strips 1*d* of Nos. 1 to 7 of the front web 1, so that they alternately occupy upper and lower positions with respect to each other, and so that upper and lower positions of the adjacent strips 2*d* are reversed, and thus the strips 2*d* and the strips 1*d* are woven so as to form a plain weave type pattern as a whole.

In this case, as shown in FIG. 3, an upper end of the strip 2*d* of No. 1 is passed through the slit 1*b* to be sent to the back surface side and is passed through the slit 1*c* to the front surface side, thereby positioning the strip 1*d* of No. 1 on the front surface side. Next, an upper end of the strip 2*d* of No. 2 is not passed through the slit 1*b* but is passed through the first slit 1*c* to be sent to the back surface side, and is passed through the next slit 1*c* to be sent to the front surface side, thereby positioning the strip 1*d* of No. 2 on the front surface side. Furthermore, an upper end of the estrip 2*d* of No. 3 is, similar to the strip 2*d* of No. 1, passed through the slit 1*b* to be sent to the back surface side, and is passed through the slit 1*c* to be sent to the front surface side. This working is further repeated. Such working is also performed for the strips 2*d* of Nos. 4 and 5, and as shown in FIG. 3, the estrips 1*d* and the strips 2*d* are woven in a slanted shape and this working is stopped.

Figure 4:
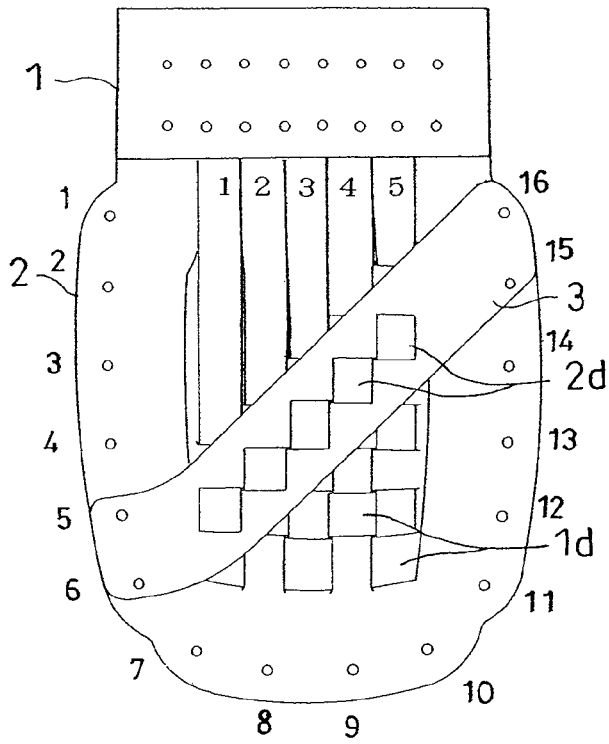

Next, during weaving of the front web 1 and the back web 2, the reinforcing member 3 is superposed to be woven. This reinforcing member 3 has a slanted band shape, as shown in FIG. 3, and six slits 3*a* are formed in a substantially central part in a longitudinal direction thereof. In addition, the tip end of the strip 2*d* of No. 1 of the back web 2 is inserted into the slit 3*a* in the lowest row of the reinforcing member 3 and again inserted into the next upper slit to be positioned under the reinforcing member 3. That is, the tip end of the strip 2*d* of No. 1 of the back web 2 is inserted into a pair of slits 3*a* of the reinforcing member 3. Furthermore, Nos. 2 to 5 of the strips 2*d* of the back web 2 are sequentially passed with respect to all the slits 3*a* of the reinforcing member 3, as shown in FIG. 4. Finally, lacing holes 3*b* formed on the right and left sides of the reinforcing member 3 and the lacing holes 2*a* (Nos. 5, 6, 15 and 16) of the back web 2 are aligned.

Figure 5:
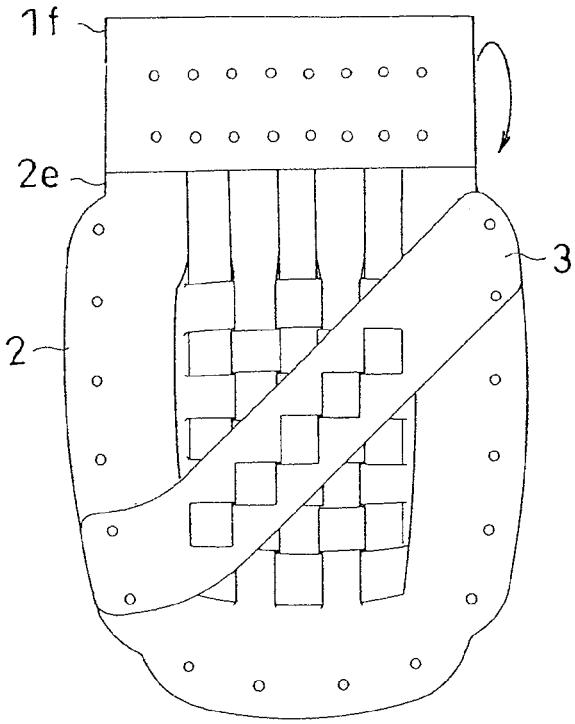

Furthermore, in the same manner as shown in FIG. 3, all the strips 2*d* of the back web 2 are passed through the slits 1*b* of the front web 1 and woven so as to be formed into a plain weave type shape. As shown in FIG. 5, when an upper side if of the front web 1 and the lacing holes 1*a* in the upper row are folded downward so that the lacing holes 1*a* in the upper row and the lacing holes 1*a* in the lower row of the front web 1 are superposed, the upper side 1*f* of the front web 1 and an upper side 2*e* of the back web 2 are superposed.

Figure 6:
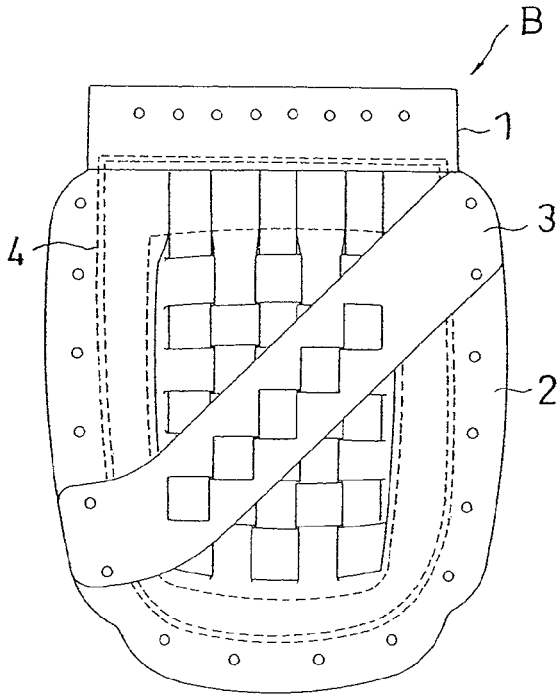
FIG. 6 shows a front view of a basket web relating to one embodiment of the present invention.
Figure 7:
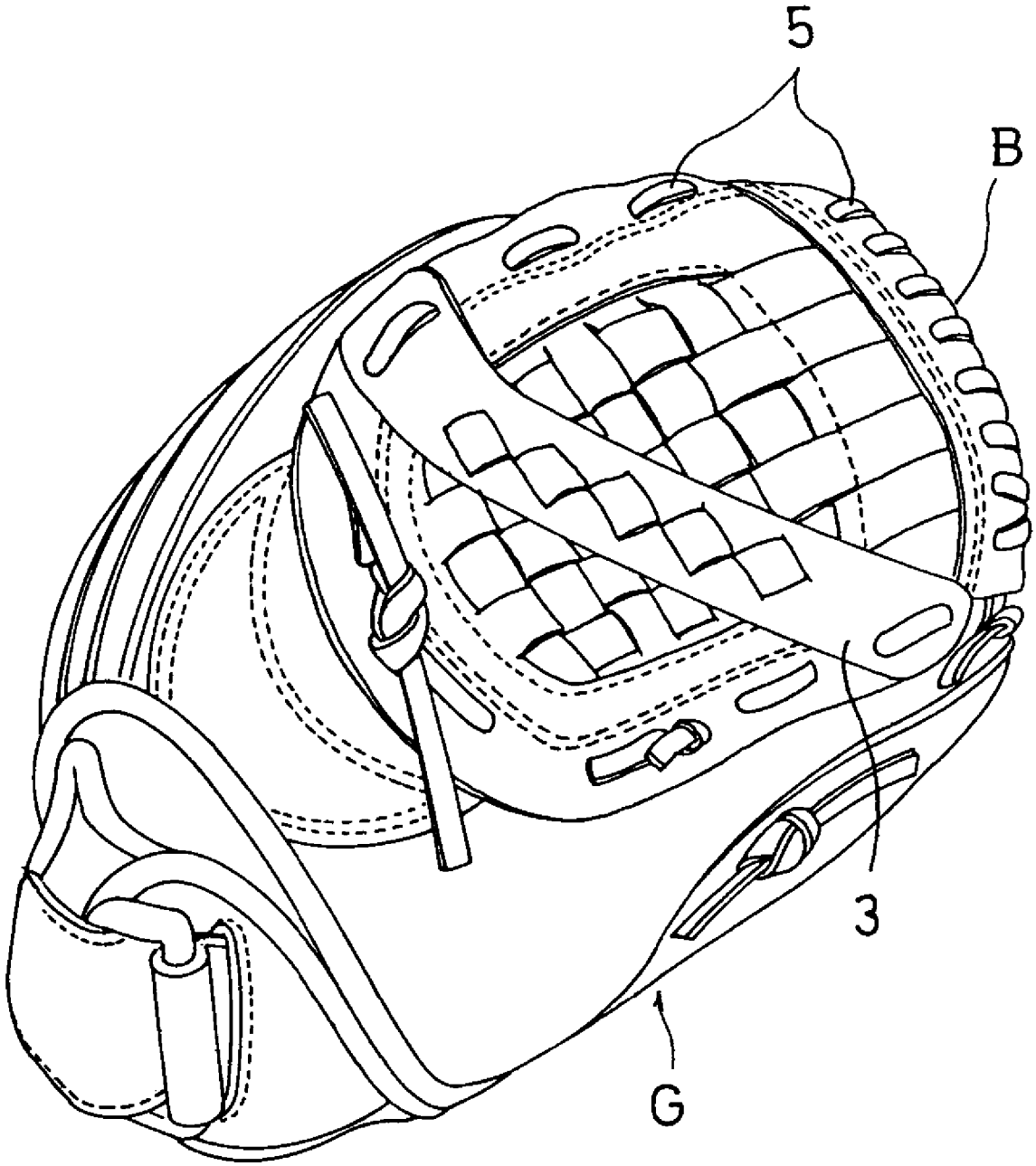
FIG. 7 is a perspective view of a globe with the basket web of FIG. 6 attached.

Thereafter, as shown in FIG. 6, in a state in which the front web 1 and the back web 2 are superposed, both are stitched and fixed with a string 4 along an arrow direction to make up a basket web. In this basket web B, as shown in FIG. 7, the side on which the reinforcing member 3 is woven is arranged on the back of the globe, and the basket web B is attached to a globe G via the lacing holes 1*a*, 2*a*, and 3*b* between an index finger and a thumb of the globe with a leather string 5.

A shape of the reinforcing member is not limited to the band slanted upward on the right as shown in FIG. 6, but may be a band slanted downward on the right and may be another form. With regard to the shape of the reinforcing member, as long as slits are formed to be woven together with the front web and the back web, various shapes can be employed. The slits of the reinforcing member are increased in number and a lattice pattern having two or more swelling parts may be formed. Furthermore, the reinforcing member is not limited to only one, but two or more reinforcing members may be used. A thickness is preferably in the range of about 0.5 to 5 mm.

Although the case where bull leather is used as a material for the front web, the back web and the reinforcing member composing the basket web is described, the present invention is not limited to this, but other natural leathers such as swine leather and deerskin, or artificial leather may be used. In particular, the reinforcing member may be made of PVC, nylon resin, rubber-based resin, silicon resin, nonwoven fabric, cloth, knitting fabric or the like, and a raw material thereof is not particularly limited.

What is claimed is:

1. A basket web comprising:

a front web in which a plurality of slits are laterally formed in a substantially central part excluding a peripheral part thereof and strips are formed between these slits;

a back web in which a plurality of slits are formed from an upper side to a lower part in a substantially central part thereof and strips are formed between these slits, and by passing these strips through the slits of the front web, the back web is superposed on the front web and both are fixed; and a reinforcing member in which a plurality of slits are formed and by passing the strips of the back web through the slits of the reinforcing member, the reinforcing member is superposed on the front web and the back web, wherein the front web and the back web are woven in a plain weave type shape, the reinforcing member has a band shape, and the strips of the back web are inserted into a pair of slits of the reinforcing member.

2. The basket web according to claim 1, wherein the reinforcing member is superposed slantingly with respect to the superposition of the front web and the back web.

3. A ball catching tool comprising:

respective finger inserting parts in which a basket web is attached between an index finger inserting part and a thumb inserting part;

wherein the basket web comprises:

a front web in which a plurality of slits are laterally formed in a substantially central part excluding a peripheral part thereof and strips are formed between these slits;

a back web in which a plurality of slits are formed from an upper side to a lower part in a substantially central part thereof and strips are formed between these slits, and by passing these strips through the slits of the front web, the back web is supewosed on the front web and both are fixed; and a reinforcing member in which a plurality of slits are formed and by passing the strips of the back web through these slits, the reinforcing member is superposed on the front web and the back web, wherein in the basket web, the front web and the back web are woven in a plain weave type shape, the reinforcing member has a band shape, and the strips of the back web are inserted into a pair of slits of the reinforcing member.

4. The ball catching tool of claim 3, wherein in the basket web, the reinforcing member is superposed slantingly with respect to the superposition of the front web and the back web.

5. A basket web comprising:

a front web having a plurality of slits generally parallel to each other, said slits defining strips formed therebetween and each of said strips having two fixed ends;

a back web having a plurality of strips generally parallel to each other in a direction generally perpendicular to the slits of the front web, each of said strips having a free tip end and a fixed end, wherein the strips of the back web and the strips of the front web are woven together by passing the tip ends of the strips of the back web through the slits of the front web, whereby the back web is superposed on the front web; and a reinforcing member having a plurality of slits generally parallel to each other in a direction generally parallel to the slits of the front web, wherein the strips of the back web and the reinforcing member are woven by passing the tip ends of the strips of the back web through the slits of the reinforcing member, whereby the reinforcing member is superposed on the back web.

6. The basket web according to claim 5, wherein the strips of the front web and the strips of the back web are plain weave type shape.

7. The basket web according to claim 6, wherein the reinforcing member is a strip traversing the plain weave type shape.

8. A ball catching tool comprising respective finger-inserting parts in which the basket web of claim 5 is attached between an index finger-inserting part and a thumb-inserting part.

9. The ball catching tool according to claim 8, wherein the strips of the front web and the strips of the back web are plain weave type shape.

10. The ball catching tool according to claim 9, wherein the reinforcing member is a strip traversing the plain weave type shape.

* * * * *